United States Patent [19]

Schmitt

[11] Patent Number: 4,748,545

[45] Date of Patent: May 31, 1988

[54] ILLUMINATION SYSTEMS

[75] Inventor: Lawrence O. Schmitt, Los Alamitos, Calif.

[73] Assignee: Reflector Hardware Corporation, Melrose Park, Ill.

[21] Appl. No.: 831,316

[22] Filed: Feb. 20, 1986

[51] Int. Cl.[4] ..... F21S 1/02

[52] U.S. Cl. ..... 362/219; 362/226; 362/232; 362/235; 362/249; 362/301

[58] Field of Search ..... 362/235, 249, 219, 226, 362/368, 346, 227, 301, 225, 232

[56] References Cited

U.S. PATENT DOCUMENTS

| | | | |
|---|---|---|---|
| 1,000,129 | 8/1911 | Taepke | 362/235 |
| 1,007,498 | 10/1911 | Spencer | 362/235 |
| 2,137,732 | 11/1938 | Swanson | 362/227 |
| 3,612,855 | 10/1971 | Juhnke | 362/235 |
| 3,633,023 | 1/1972 | Castiglioni et al. | 362/225 |
| 4,158,221 | 6/1979 | Agabekov | 362/249 |
| 4,339,790 | 7/1982 | Hanson et al. | 362/346 |
| 4,521,838 | 6/1985 | Agabekov | 362/249 |
| 4,639,841 | 1/1987 | Salestrom et al. | 362/227 |

FOREIGN PATENT DOCUMENTS

| | | | |
|---|---|---|---|
| 471363 | 10/1914 | France | 362/219 |

*Primary Examiner*—Andrew M. Dolinar

*Attorney, Agent, or Firm*—Dressler, Goldsmith, Shore, Sutker & Milnamow, Ltd.

[57] ABSTRACT

An illumination system usable in a display cabinet includes a plurality of spaced apart, low-voltage lamps. The lamps are supported by a reflector off-set from a shell or housing. The air space created between the reflector and the shell or housing provides thermal insulation such that the system will not excessively heat the display cabinet.

15 Claims, 4 Drawing Sheets

ILLUMINATION SYSTEMS

FIELD OF THE INVENTION

The invention pertains to illumination systems. More particularly, the invention pertains to illumination systems usable to provide light to display cabinets or cases to enhance merchandise being displayed.

BACKGROUND OF THE INVENTION

Light fixtures or illumination fixtures for use in display cabinets are well-known. Typically, these fixtures incorporate fluorescent tubes mounted within a reflective housing. Fluorescent fixtures have become commonly used in display cabinets due to their economy and relatively low operating temperature. The relatively low operating temperature of fluorescent tubes results in relatively minimal thermal insulation requirements in the fixture.

On the other hand, the frequency spectrum of the light generated by fluorescent tubes may not include all of the frequencies found in light generated by incandescent lamps. Further, a fluorescent tube produces a broad, flat illumination rather than the highly reflective, concentrated point light sources produced by incandescent lamps. Hence, in certain types of displays, particularly displays of jewelry, fluorescent lighting is less popular.

Fixtures for use in display cabinets which incorporate incandescent lamps are also known. Such lamps tend to be operated off of standard 110 volt electrical power and generate substantial quantities of heat. The heat generated by such lamps imposes more stringent thermal insulation requirements upon the fixtures. In addition, the heat generated by prior art, incandescent lamp fixtures can under some circumstances be deleterious to the objects or merchandise being displayed.

Thus, there continues to be a need for fixtures or lighting systems usable with display cabinetry which provide the benefits of light generated by incandescent lamps, including the warm color, extra sparkle and greater definition of texture such lamps provide. However, there also continues to be a need for fixtures which generate the relatively minimal amounts of heat comparable to

SUMMARY OF THE INVENTION

In accordance with the invention, a reflector system, slidable into a shell or housing of an existing display cabinet lighting fixture, is provided. The reflector system includes a three-sided, generally U-shaped, inner liner slidably receivable within the shell. An elongated reflector is carried by the liner offset therefrom. A plurality of spaced-apart sockets is affixed to the elongated reflector. Low-voltage light sources or lights are removably retained by the sockets. The lights can be incandescent or tungsten halogen lights. Low voltage electrical energy to energize the light sources is provided by a transformer.

Further, in accordance with the invention, an illumination system is provided. The illumination system includes an elongated shell which slidably receives an offset reflecting member. A plurality of light sources, such as low-voltage lights, are spaced along the reflecting member in sockets affixed to that member.

Improved thermal characteristics can be achieved, to keep the system cool, by circulating cooling air between the shell and the reflecting member. Alternately, the space between the shell and the reflecting member can be filled with thermal insulation.

A low-voltage transformer, such as one with a 12 volt output, can be used to provide electrical energy to the reflector system or the illumination system. If used to illuminate a display cabinet, the transformer can be installed in the ballast compartment of the cabinet.

The length of the reflector system or the illumination system can be varied in accordance with the length of the cabinet. Similarly, the number of light sources, or lamps, can be varied to attain the desired level of illumination.

Low-voltage lighting systems, in accordance with the present invention, are advantageous in that the lamps act as spaced-apart point sources. Enough separation can be maintained between adjacent lamps to provide for maximum light reflection off of the objects being displayed. The frequencies of light generated by the low voltage incandescent or halogen lamps are desirable in that they add warmth, sparkle and brilliance to the objects being displayed.

Further, in accordance with the invention, a modular illumination system, installable in spaced-apart fluorescent tube sockets, is provided. This illumination system has an elongated housing corresponding to the space between the sockets, and axial conducting members, corresponding to the conducting pins that extend from the ends of a fluorescent tube, that extend from the ends of the housing. The conducting members slidably engage the conductors in the spaced-apart sockets. The housing carries an elongated reflector. A plurality of spaced-apart low-voltage lamp sockets are secured to the reflector. Low-voltage lamps are removably inserted into the lamp sockets.

This modular system is advantageous in that it can be used to directly replace existing fluorescent lamps. A low-voltage transformer replaces the ballast needed for the fluorescent tubes.

Low-voltage electrical energy generated by the transformer can be coupled to the light sources via the conductors in the sockets. Alternately, additional terminals can be provided at the ends of the housing. The transformer output can be coupled to those terminals by low-voltage wiring.

Numerous other advantages and features of the present invention will become readily apparent from the following detailed description of the invention and the embodiments thereof, from the claims and from the accompanying drawings in which the details of the invention are fully and completely disclosed as a part of this specification.

DESCRIPTION OF THE DRAWINGS

FIGS. 1A and 1B are fragmentary, prespective views of a portion of a display cabinet, with an attached mounting rail, to which an elongated fixture shell can be mounted;

DETAILED DESCRIPTION OF THE PREFERRED EMBODIMENTS

Figures 2, 3:
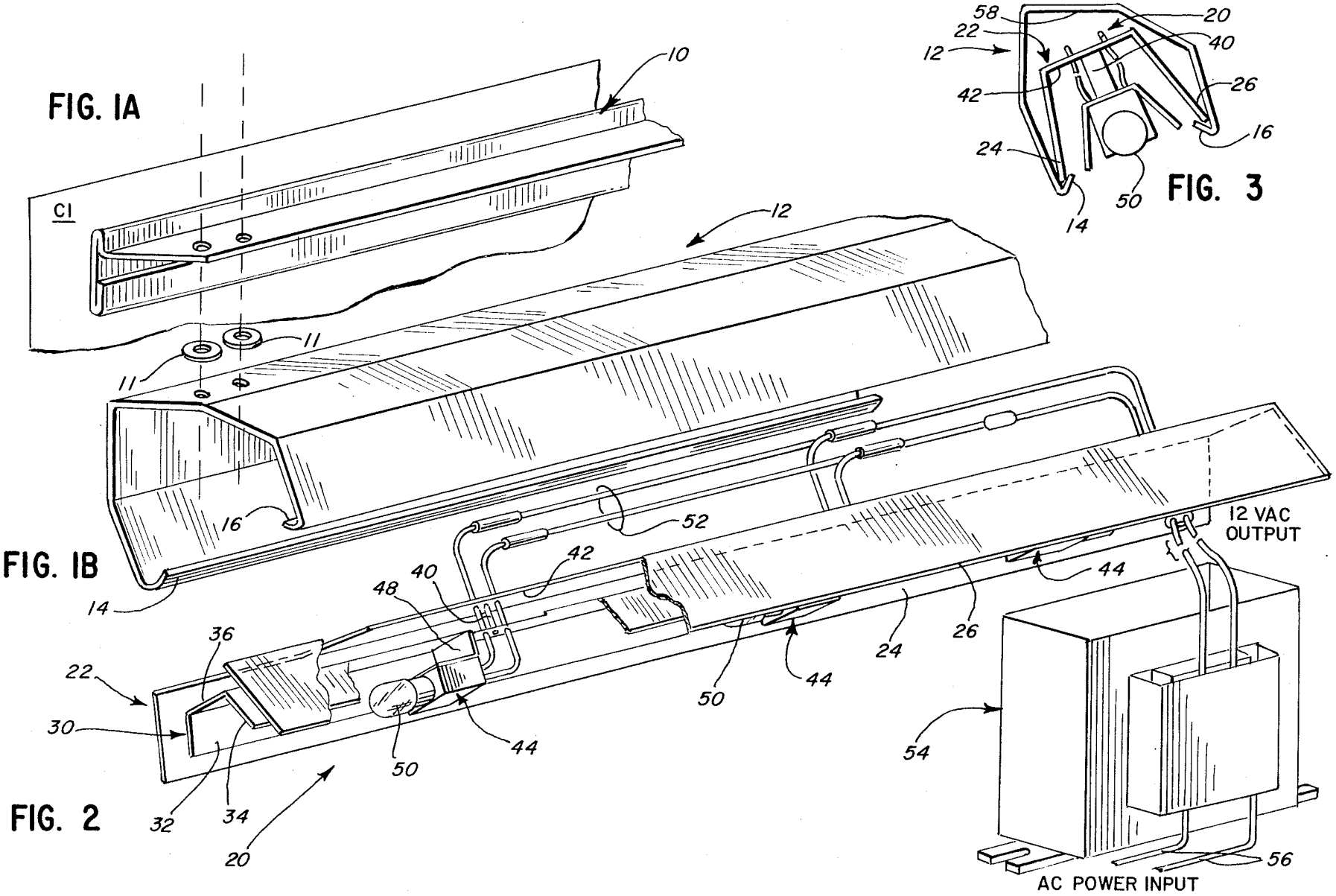
FIG. 2 is a view in perspective partly broken away, of a reflector system insertable into the fixture shell of FIG. 1B.
FIG. 3 is an end view of the reflector system of FIG. 2.

While this invention is susceptible of embodiment in many different forms, there is shown in the drawing and will be described herein in detail specific embodiments thereof with the understanding that the present disclosure is to be considered as an exemplification of the principles of the invention and is not intended to limit the invention to the specific embodiments illustrated.

With respect to the figures, FIG. 1A illustrates a fragmentary portion of a display cabinet C1 to which is affixed a display fixture mounting rail 10. FIG. 1B illustrates a fixture shell 12 which is attachable to the mounting rail 10. Preferably insulating washers 11 are interposed between rail 10 and shell 12 to insulate them electrically and thermally from each other. The shell 12 is intended to contain a light source or sources for the purpose of illuminating objects within the cabinet C1. The shell 12 terminates in a pair of elongated lips 14, 16.

It will be understood that the exact shape and manner of attaching the rail 10 to the cabinet C1 is not a limitation of the present invention. Similarly, it will be understood that the exact shape of the shell 12 is not a limitation of the present invention. The length of the rail 10 and the shell 12 would correspond to the region or length of cabinet C1 which is intended to be illuminated.

FIG. 2 illustrates a reflector system 20 in accordance with the present invention. The reflector system 20 is designed to be slidably received within the shell 12, supported by the lips 14, 16. The reflector system 20 can be used in conjunction with shells which are being newly installed in cabinets, such as the cabinet C1. Alternately, the reflector system 20 can be used as a replacement for incandescent bulbs or fluorescent tubes mounted within previously installed shells, such as the shell 12.

The reflector system 20 includes an elongated, inner liner 22. The liner 22 is a metal, for example, aluminum, three-sided, U-shaped member. The member 22 includes a pair of edges 24 and 26 which slidably engage the lips 14 and 16 of the shell 12. The length of the inner liner 22 corresponds to the desired length of the cabinet C1 which is to be illuminated.

Carried by and affixed to the inner liner 22 is an elongated reflective member 30. The member 30 is a metal, for example, aluminum, three-sided, U-shaped member having planar sides 32 and 34. The sides 32 and 34 are joined by a planar central member 36. The reflecting member 30 is supported by the inner liner 22 and offset therefrom.

The reflecting member 30 is offset from the liner 22 by a plurality of spaced-apart, cylindrical standoffs or spacers 40. Thus, an air space 42 is defined therebetween. Each of the spacers 40 is of a material which has a low thermal conductivity, such a ceramic material.

The spacers 40 may be affixed to the inner liner 22 in any conventional manner such as by means of screws or rivets. Similarly, the reflecting member 30 may be affixed to the standoffs 40 in a similar fashion.

A plurality of spaced apart light sockets 44 is supported by the reflecting member 30. The light sockets 44 may be of any conventional type. The sockets 44 are fixedly attached to the reflecting member 30 by L-shaped brackets, such as the bracket 48. The brackets 48 support the sockets 44 offset from the reflecting member 30.

Each of the sockets 44 removably receives a source of illumination or lamp, such as the source of illumination 50. Typical sources of illumination usable in connection with the reflector system 20 are low-voltage, high-intensity, incandescent lamps or low-voltage, halogen lamps. It will be understood that the exact shape and configuration of the sockets 44 and the lamps 50 are not a limitation of the present invention. Although the preferred low-voltage lamps are 12 volt lamps, other low voltage lamps, such as 5 volt lamps or others up to 35 or 40 volts may be used.

Electrical energy can be supplied to the lamps 50 via electrical conductors 52. Each of the lamps 50 is connected in parallel with each of the other lamps. As a result, if one of the lamps fails or burns out, the remainder continue to operate.

A low-voltage transformer 54 which generates a 12 volt nominal output is used as a source of low-voltage electrical energy when the lamps used are 12 volt lamps. The transformer 54 converts standard line voltage on lines 56 to the desired 12 volt output on the lines 52.

FIG. 3 illustrates, in an end view, the relationship between the shell 12 and the reflector system 20. The edges 24 and 26 of the reflector system 20 are slidably received by the lips 14 and 16 of the shell 12. The inner liner 22 is offset and spaced apart from the shell 12. Thus, an air space 58 is defined therebetween. Further, the ceramic spacers or standoffs 40 support the reflector member 30 also offset with respect to the liner 22. In addition, the lights 50 are offset with respect to the reflector member 30.

Hence, substantial thermal insulation is present in the form of the air space 58 and between the shell 12, and the reflecting system 20. In addition, further thermal insulation is present in the air space 42 between the reflecting member 30 and the inner liner 22. As a result, it has been observed that the reflecting system 20, when installed in a liner 12, generates minimal amounts of heat at the exterior surfaces of the cabinet C1.

On the other hand, because the sources of illumination or lights 50, are spaced apart from one another and function as a plurality of point sources, adequate separation can be maintained between the light sources to assure maximum reflective angles with respect to the object being displayed so as to create the desired brilliance. In addition, the incandescent or halogen-type lamps 50 are known to have a frequency range which provides sparkle, warmth and brilliance with respect to the objects being shown.

In a preferred form of the invention, the light sockets 44 are about ½ inch wide and the reflecting member 30 is about ½ inch deep. The required number of light sources or lamps 50 can be determined based on the length of the cabinet C1 with which the reflecting system 20 is to be used.

Figures 4, 5, 6, 7:
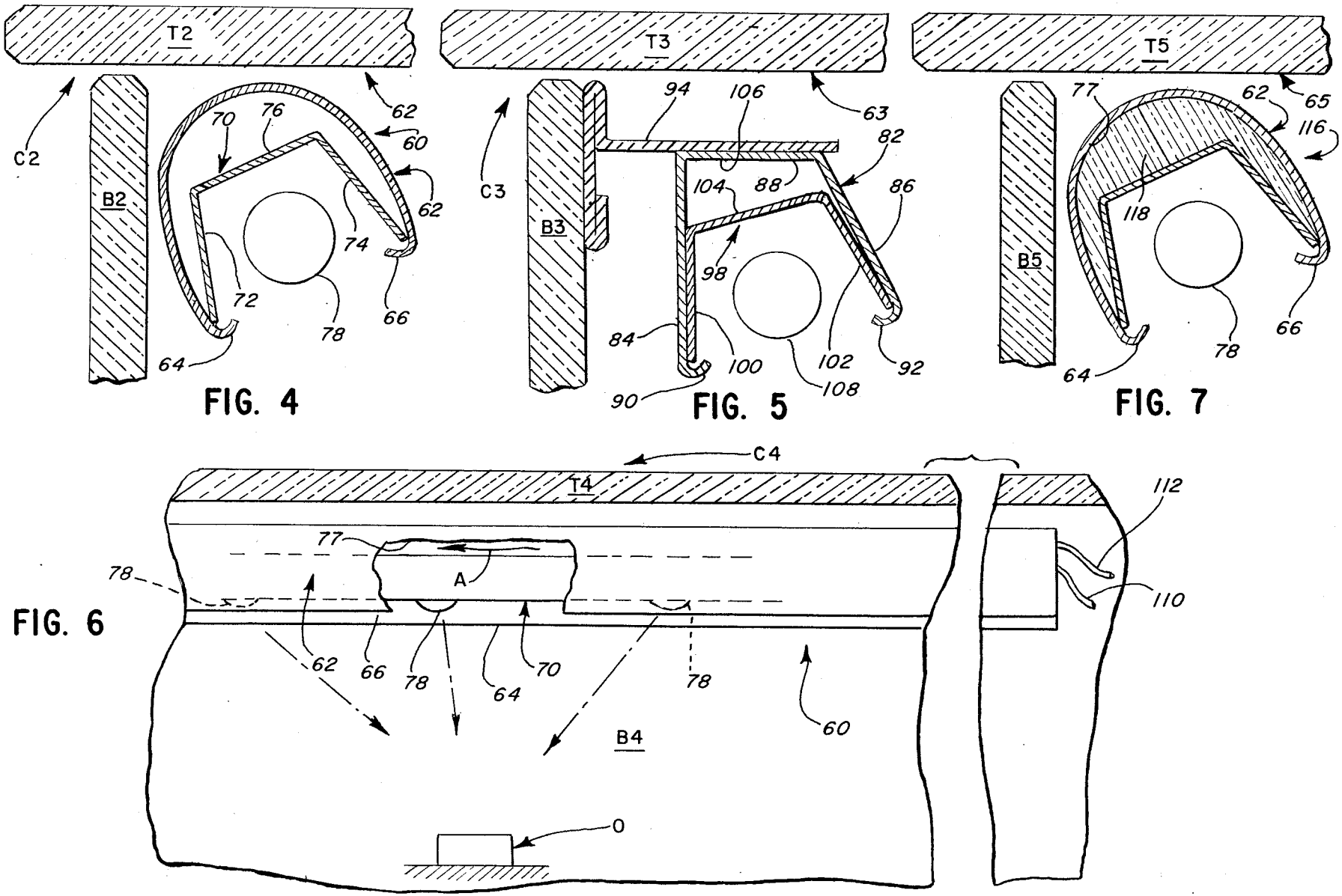
FIG. 4 is a diagramatic end view of an illumination system, in accordance with the present invention, mounted in a display cabinet.
FIG. 5 is a diagramatic end view of an alternately shaped illumination system, in accordance with the present invention, mounted in a display cabinet.
FIG. 6 is a fragmentary, elevational view, partly broken away, illustrating an illumination system in accordance with the present invention, mounted in a display cabinet.
FIG. 7 is a diagramatic end view of an illumination system as in FIG. 4 incorporating thermal insulation in accordance with the present invention.

FIG. 4 illustrates, in schematic form, an end view of an illumination system 60 in accordance with the present invention. The system 60 is affixed to a display cabinet C2 having a top T2, which might be transparent and formed of tempered glass, with an essentially perpendicular back B2. The illumination system 60 could be affixed to the cabinet C2 by means of a mounting rail such as the rail 10.

The illumination system 60 includes an outer, elongated shell 62 with a generally cylindrical exterior peripheral surface. The shell 62 terminates in lips 64 and 66.

A reflector 70 is slidably received within the shell 62 and supported by the lips 64 and 66. The reflector 70 is a three-sided, U-shaped member with sides 72 and 74 joined by a central region 76. The reflector 70 is offset from the shell 62 for the purpose of increasing the thermal insulation therebetween. An air space 76 is thus defined therebetween.

A plurality of spaced apart light sources or lamps may be removably mounted in sockets which are in turn affixed to the reflector 70. A typical light source or lamp 78 is illustrated in FIG. 4. Light sources or lamps corresponding to the lamps 50 of the reflector system 20 could be used with the illumination system 60. Further, light sockets such as the sockets 44 and supporting brackets 48 could also be used with the illumination system 60. It is will be understood that neither the exact shape of the light sockets nor their mounting brackets are a limitation of the present invention.

By virtue of the fact that the light sources 78 are relatively small, having diameters on the order of 3 mm, the illumination system 60 may be made substantially smaller than was possible with the prior art illumination systems. For example, the shell 62 of FIG. 4 could be formed with an overall height of about 2.5 inches with the central member 76 of the reflector 70 offset from the shell 62 on the order of 8 mm.

The above configuration provides substantial illumination for use in displaying the objects in the display case. However, because of the air space 76 defined between the shell 62 and the reflector 70, the illumination system 60 has excellent thermal insulating properties. As a result, the top T2 and back B2 of the cabinet C2 receive little heat from the illumination system 60 and are therefore comfortable to the touch.

FIG. 5 illustrates an alternate form of illumination system 80. The illumination system 80 is illustrated in FIG. 5 in an end view affixed to a back B3 of a display cabinet C3. The illumination system 80 includes an outer shell 82 formed as a U-shaped member with two planar sides 84 and 86 joined by a planar central member 88. The planar sides 84 and 86 terminate in respective inwardly oriented lips 90 and 92. The member 88 is affixed to a mounting bracket 94 which is in turn attached to the back B3 of the cabinet C3.

A reflector 98 is slidably received with the shell 82. The reflector 98 has a generally U-shaped cross-section with two planar side members 100, 102 joined by a planar central member 104. An air space 106 is defined between the shell 82 and the reflector 98.

The reflector 98 is slidably supported by the lips 90, 92. By offseting the reflecting member 98 from the shell 82, thereby forming the air space 106, the thermal insulating characteristics of the illumination system 80 are greatly enhanced.

A plurality of spaced-apart, low-voltage light sources or lamps, indicated symbolically at 108 can be removably supported in a plurality of low-voltage sockets. The sockets can in turn be affixed to the reflector 98 by means of brackets.

Light sources or lamps, such as the lamps 50 of the reflector system of FIG. 2, may be used with the lighting system 80. In addition, sockets such as the sockets 44 and brackets 48 of the reflector system 20 may also be used with the illumination system 80.

FIG. 6 illustrates an elevational view of cabinet C4 with a top T4 and back B4 in which is mounted the illumination system 60. It will also be understood that the lighting system 80 could be installed in the cabinet C4 in precisely the same fashion. The light sources 78 are illustrated in FIG. 6 supported by the reflector 70. As can be seen in FIG. 6, the spaced-apart light sources 78 provide sources of illumination at various angles with respect to the object 0 being displayed. By providing a plurality of spaced-apart point sources, the reflectivity and brilliance of the object O are enhanced.

Electrical energy can be supplied to the illumination system 60 via a low-voltage wiring system 110. The wiring system 110 can be coupled to a transformer, corresponding to the transformer 54, which can be located in the ballast compartment of the cabinet C4.

To further cool the illumination system 60, air can be circulated between the reflector 70 and the shell 62, in the air space 76 as indicated by the arrow A. The flow of air A can be achieved by means of a blower or fan mounted at an end of the illumination system 60 or by attaching an end of a hose or tube 112 thereto. The other end of the hose or tube 112 can be attached to a blower or fan. In this instance, the blower or fan can also be located in the ballast compartment along with the transformer.

It will be understood that a wide variety of shell cross-sections could be developed as alternates to the shells 62 and 82 of the illumination systems 60 and 80. Similarly, it will be understood that a wide variety of reflectors could be developed, corresponding to the reflectors 70 and 98. It will be understood that neither the exact cross-sectional shape of the shells nor the cross-sectional shape of the reflectors such as 70 and 98, respectively, are a limitation of the present invention.

FIG. 7 illustrates an end view of another illumination system 116. Those elements of the system 116 which correspond to the elements of previously discussed FIG. 4 are given the same identification numerals in FIG. 7. As an alternate to the thermal characteristics of the air space 76 used as an insulator in the illumination system 60, a solid, non-petroleum based, thermal insulator 118 is used to fill the region 77 of the lighting system 116. Use of the solid insulation 118 has the advantage that improved thermal characteristics are achieved without the use of a blower or fan. It will be understood that where so used, the solid thermal insulation 118 extends the entire length of the region 77 in the illumination system 116.

Figure 8:
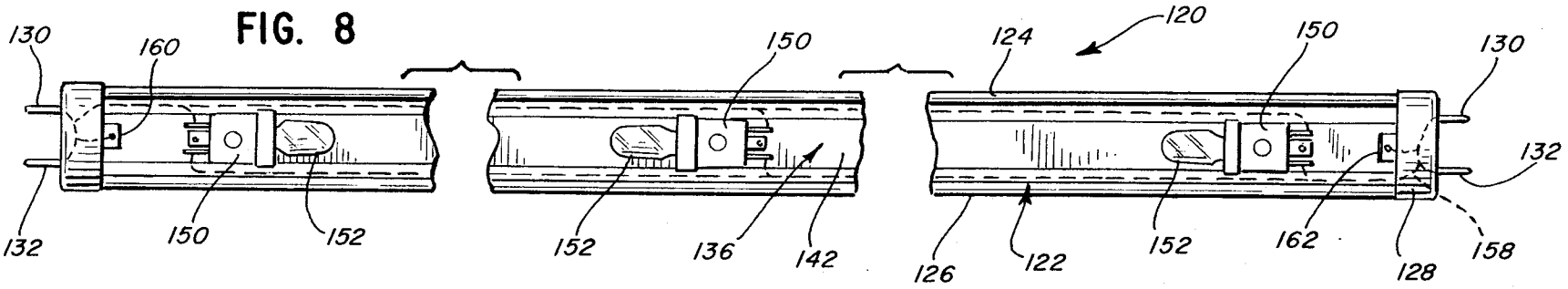
FIG. 8 is a plan view of a modular illumination system in accordance with the present invention.

FIG. 8 illustrates yet another embodiment of the present invention. A modular illumination system 120, as illustrated in FIG. 8, includes an elongated, essentially cylindrical housing 122 which terminates along its length in a pair of lips 124 and 126. Housing 122 is desirably molded from a heat resistant rigid plastic. The housing 122 terminates axially in end caps 128. Each of the end caps 128 carries and supports a pair of axially extending, conducting members 130 and 132. Although dual pin conductors are shown, it is apparent that single conductor end caps as known in the art may be used as well.

The conductors 130 and 132, if desired, could be electrically insulated from the end caps 128. The housing 122 in combination with the end caps 128 and the axially extending conductive members 130 and 132 is selected to be of the same length and diameter as a fluorescent tube of a given wattage. The modular illumination system 120 is intended as a direct replacement for a correspondingly, physically-sized, fluorescent tube.

Figure 10:
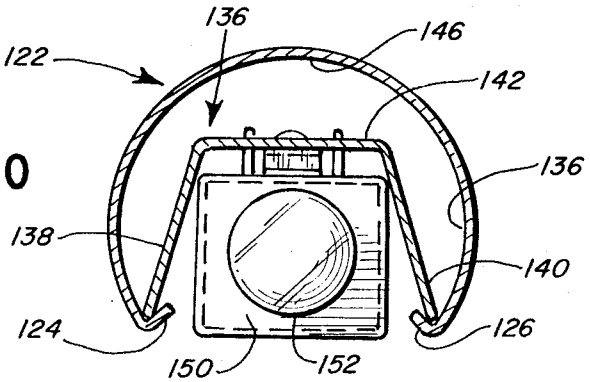
FIG. 10 is a view in section taken along line 10—10 of FIG. 9.

An elongated reflective member 136 is positioned within and supported by the housing 122. The reflector 136 has a generally U-shaped cross-section, as illustrated in FIG. 10, with a pair of planar side members 138 and 140 joined by a central planar member 142. The side members 138 and 140 slidably engage the lips 124 and 126 of the housing 122.

An air space 146 is defined between the housing 122 and the reflector 136. The reflector member 136 is thus positioned within the housing 122 but offset therefrom. This offset and the corresponding air space 146 defined therebetween improves the thermal insulation of the modular lighting system 120. Affixed to the planar central member 142 of the reflector 136 are spaced-apart, low voltage sockets 150. The sockets 150 are fixedly attached to the member 142 by rivets, screws or the like.

The sockets 150 each removably receive a light source 152. The light sources 152 may be low-voltage, incandescent lamps or halogen lamps. The number of sockets and light sources 152 mounted within a given modular lighting system 120 is a function of the desired length of the housing 122 as well as the intensity of the desired illumination in the display cabinet or other area being illuminated. It will be understood that the exact configuration or shape of the sockets 150, the way those sockets are attached to the member 142, and the number of sockets within a given housing 122 are not a limitation of the present invention.

Low-voltage electrical energy can be supplied to the light sources 152 via the axially extending conducting members 130, 132 in combination with conductive members 158, for example, low-voltage wires, within the housing 122.

Alternately, if desired, auxilliary terminals 160 and 162 can be affixed to the housing 122, insulated therefrom, and coupled to the conductors 158. The terminals 160, and 162 can in turn be coupled to exterior low-voltage wiring which is itself coupled to a low-voltage transformer such as the transformer 54. In this particular embodiment, the axially-extending conductive members 130, and 132 are used for the purpose of providing mechanical support for the system 120 and not for the purpose of supplying electrical energy thereto.

Figure 9:
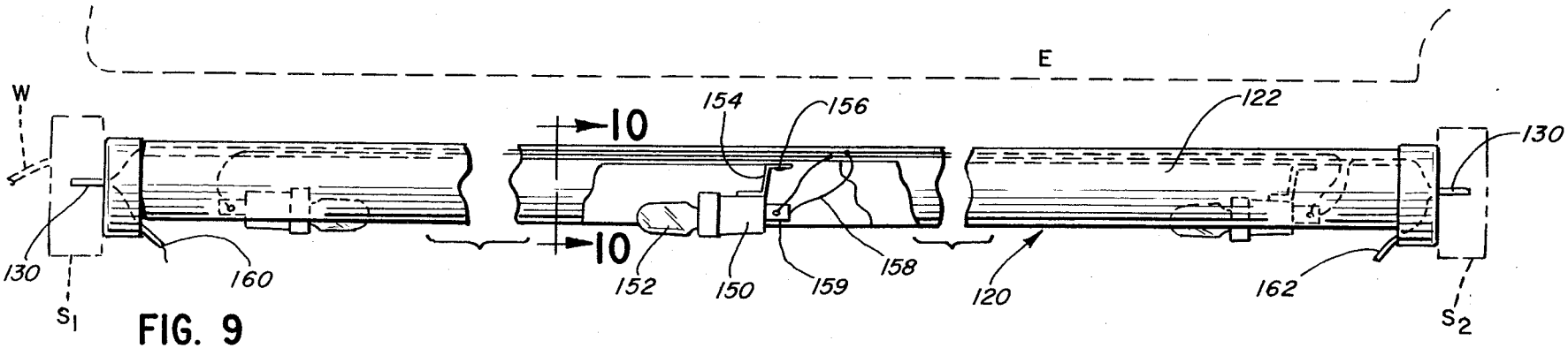
FIG. 9 is an elevational view, partly broken away, of the modular illumination system of FIG. 8.

FIG. 9 illustrates the system 120 removably installed in a fluorescent lighting fixture F, shown schematically in phantom, having a pair of spaced-apart fluorescent sockets S1, S2 also shown in phantom. As illustrated in FIG. 9, the system 120 is mechanically supported via its axially conducting members 130, 132 in the sockets S1 and S2. Low-voltage wiring W provides electrical energy to the sockets S1 and S2 which in turn is transmitted to the system 120 via the conductive members 130, 132. As can be seen in FIG. 9, the light sockets 150 are supported by L-shaped brackets 154. The brackets 154 are in turn affixed to the member 142 by rivets 156. Conductors 158, low-voltage wires, are affixed to the sockets 150 by terminals 159 which extend axially, rearwardly from the sockets 150.

The system 120 is particularly advantageous in that it provides a direct replacement for existing fluorescent tubes within existing fluorescent fixtures, such as the fixture F. When so used, the system 120 provides a replacement illumination system with a plurality of light sources spaced apart from one another. The incandescent or halogen-type light sources usable with the system 120 have a frequency spectrum with frequencies which provide warmth and brilliance to objects being displayed. Corresponding frequencies are not found in the frequency spectrum of fluorescent tubes. Hence, the system 120 displays objects in a showcase much more advantageously than the existing fluorescent fixtures.

FIG. 10 illustrates the offset relationship between the sockets 150 and the reflective member 136. The L-shaped brackets 154 offset light sources 152 from the reflective member 136. As noted above, the reflective member 136 is in turn offset from the housing 122. As a result, the air spaces between the light sources 152 and the housing 122 results in the system 120 operating at a temperature on the order of 100° F. Typical fluorescent fixtures operate at a temperature of about 88° F. Hence, the system 120 imparts only a very limited amount of heat to the adjacent display case, making the display case feel warm and comfortable to the touch.

Figures 11, 12:
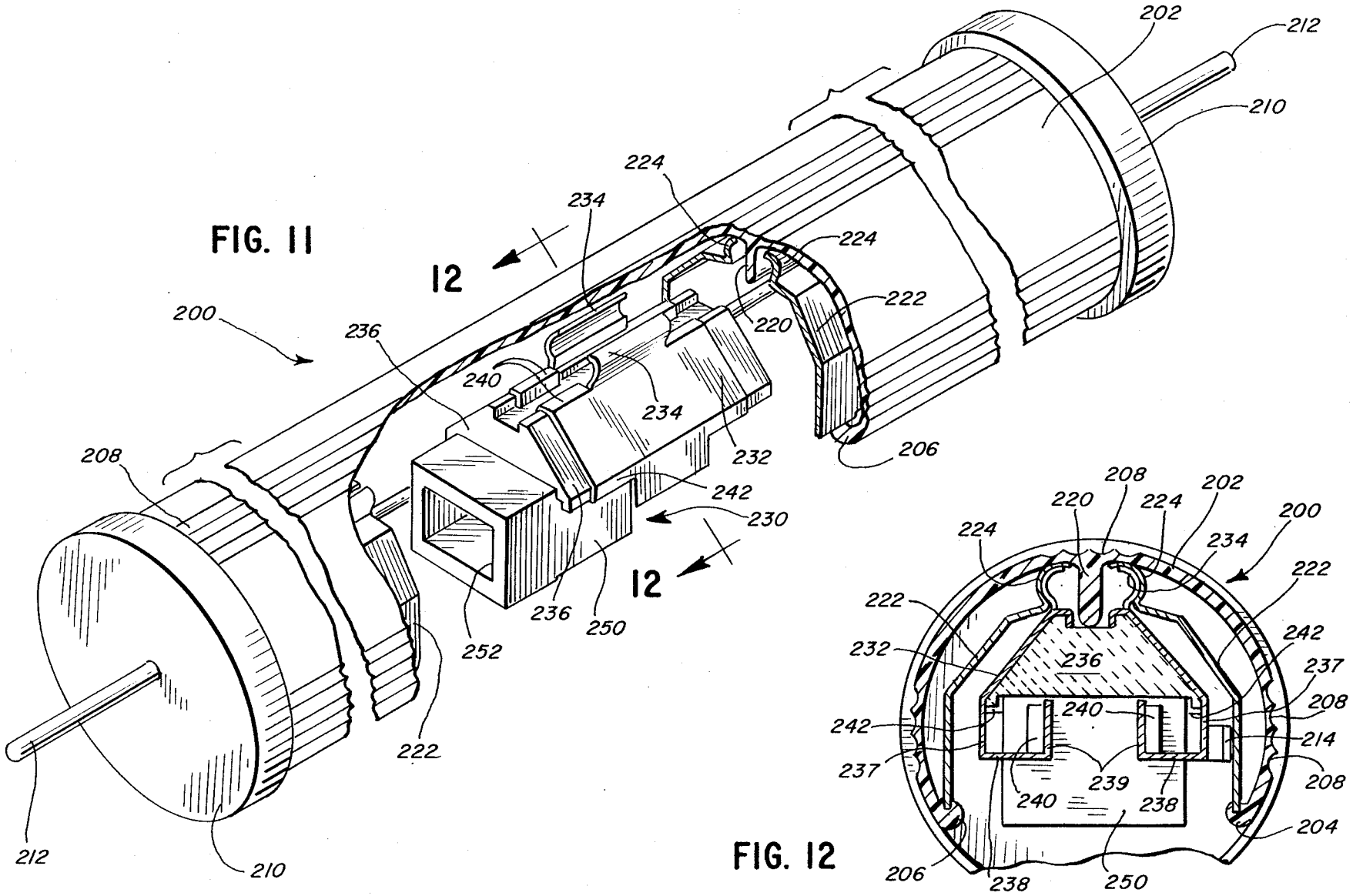
FIG. 11 is a fragmentary perspective view of a further modular illumination system in accordance with the present invention.
FIG. 12 is a view in section taken along line 12—12 of FIG. 11.

FIGS. 11 and 12 illustrate yet another embodiment of the present invention. A modular illumination system 200, as illustrated in FIG. 11, includes an elongated, essentially parti-cylindrical housing 202 which terminates along its longitudinal edges in a pair of support lips 204 and 206. Housing 202 is desirably formed of a high temperature resistant plastic such as a high temperature polyester. It may define longitudinal scallops 208 for ease of gripping. The housing 202 terminates axially at end caps 210 which each carry and support an axially extending conductor 212.

If desired, the conductor 212 may be electrically insulated from the end caps 210. Each end cap 210 is proYided internally with a spring-like contactor blade 214 which is electrically connected to its associated conductor 212. The end blades 214 are configured to bear respectively against associated reflector sections 222, one against one reflector section 222 at one end and the other against the other reflector section at the other end. The housing 202, in combination with the end caps and the axially extending conductors, is selected to be of the same length and diameter as a fluorescent tube of a given wattage. Thus, the modular illumination system 200 is intended as a direct replacement for a correspondingly, physically-sized, fluorescent tube, such as where its use as a retrofit system is desired.

The housing also defines a divider rib 220 which projects downwardly from the center of housing 202. Together with support lips 204, 206, rib 220 serves to position, support and insulate from each other a pair of metallic, electrically conductive reflector sections 222. Reflector sections 222 are seated at their lower edges on the support lips 204, 206, respectively, and are formed with curved upper segments 224. These segments are spring-like and are proportioned to snap-receive and to support, and to be electrically coupled to complementary portions of socket assemblies 230.

Socket assemblies 230 comprise a pair of conductive mounting contactors 232 having curved upper portions 234 which snap into and mate with curved upper segments 224. Each contactor 232 is in turn separately, physically secured to an insulating socket holder 236, as of ceramic, as by upper legs 240 and lower legs 242 suitable crimped or secured thereto. In turn, socket holder 236 is adapted to mount an insulating socket 250.

To that end, a lower extension of the contactors 232 comprises a vertical section 237, an inturned portion 238 and an upwardly extending portion 239 to define a U-shaped receptacle. Plug-like contactors 240 which project rearwardly from socket 250 electrically couple the reflectors 222, hence the conductors 212 to the socket 250. Each socket 250 defines an opening 252 to receive a lamp and a suitable internal mount, such as a bayonet mount, for a light source, such as a low-voltage, incandescent lamp or a halogen lamp like those described in connection with the preceeding embodiments.

Thus, each socket assembly may be snap connected as a unit to the reflector sections to provide a source of power for as few or as many socket assemblies or bulbs as one cares to provide along the length of the modular illumination system. The individual sockets 250 and/or bulbs may be replacebly plugged into the assembly as desired. The system may be installed as a unit either for retrofit use or in new display constructions. Further, like other of the embodiments described above, the arrangement of the parts provides insulating air spaces which limit the amount of heat imparted to the adjacent display case, making the case feel comfortable to the touch.

From the foregoing, it will be observed that numerous variations and modifications may be effected without departing from the true spirit and scope of the novel concept of the invention. It is to be understood that no limitation with respect to the specific embodiments illustrated herein is intended or should be inferred. It is, of course, intended to cover by the appended claims all such modifications as fall within the scope of the claims.

What is claimed is:

1. A modular illumination system insertable into spaced-apart power supply sockets comprising:

an elongated housing;

a plurality of spaced-apart light source sockets carried by said housing;

a plurality of spaced-apart, electrically energized, low-voltage, removeable and replaceable light sources offset from and carried by said housing;

reflector means carried by said housing; and first and second conducting means affixed to and extending in part from respective first and second ends of said housing past the lengthwise extent of said housing, with each said conducting means axially oriented in part with respect to the lengthwise direction of said housing said conducting means engageable with the spaced-apart power supply sockets to mechanically support said housing inflexibly therefrom and electrically connect said light source sockets to, a power supply.

2. A modular illumination system as in claim 1 and wherein said light source sockets are coupled to said reflector means.

3. A modular illumination system as in claim 2 and wherein said plurality of light source sockets is affixed to said reflector means.

4. A modular illumination system as in claim 3 including conducting members coupled between said conducting means and said light source sockets.

5. A modular illumination system as in claim 3 including connector means, affixed to said housing for supplying electrical energy to said light sources.

6. A modular illumination system as in claim 3 wherein said reflector means is a three-sided, elongated, reflecting metal member.

7. A modular illumination system as in claim 3 wherein said light sources are low-voltage incandescent lamps.

8. A modular illumination system as in claim 3 wherein said light sources are low-voltage halogen lamps.

9. A modular illumination system insertable into spaced-apart power supply sockets comprising:

an elongated housing;

a plurality of spaced-apart light source sockets carried by said housing;

a plurality of spaced-apart, electrically energized, low-voltage, removeable and replaceable light sources offset from and carried by said housing;

reflector means carried by said housing; and first and second axially extending conducting means affixed to and extending from respective first and second ends of said housing, said conducting means engageable with the spaced-apart sockets to mechanically support said housing therefrom, and electrically connect said system to a power supply wherein said housing is of an insulating material and further wherein said reflector means comprises a pair of spaced conductive, elongate reflector members positioned within and supported by said housing with said reflector members electrically coupled between said conducting means and said light source sockets.

10. A modular illumination system insertable into spaced-apart power supply sockets comprising:

an elongated housing of an insulating material;

a pair of spaced conductive, elongate reflector members positioned within and supported by said housing;

a plurality of light source sockets, one for each of a plurality of light sources, electrically connected to said reflector members;

a plurality of spaced-apart electrically energized, low-voltage, light sources offset from and carried by said sockets; and first and second axially extending conducting means affixed to and extending from respective first and second ends of said housing, said conducting means engageable with the spaced-apart sockets to mechanically support said housing therefrom, and electrically connect said system to a power supply.

11. A modular illumination system as in claim 10 and wherein said light source sockets are each removably snap-connected to said reflector members.

12. A modular illumination system as in claim 10 wherein said reflector members are each electrically connected to conductors which are connected to said power supply sockets.

13. A modular illumination system insertable into spaced-apart power supply sockets comprising:

an elongated housing;

at least first and second axially extending conducting means affixed to and extending from said housing, said conducting means engageable with the spaced-apart sockets to mechanically support said housing therefrom, and electrically connect said system to a power supply;

first and second rigid elongated conductive members carried by said housing and electrically coupled to respective of said first and second conducting means; and a plurality of light source sockets, each of said sockets having spring biased engaging means for removably engaging, electrically and mechanically said first and said second rigid conductive members such that said light source sockets may be positioned selectively along said elongated conductive members and electrical power can be supplied through said conductive members to said sockets.

14. A modular illumination system as in claim 13 including reflector means carried by said housing adjacent said light source sockets.

15. A modular illumination system insertable into spaced-apart support sockets comprising:

an elongated housing;

first and second rigid, elongated, conductive members carried by said housing;

first and second axially extending conducting means affixed to and extending, at least in part, from said housing, said conducting means electrically coupled to respective of said first and second conductive members, said conducting means engageable with the spaced-apart sockets to mechanically support said housing therefrom and electrically connect said conductive members to a power supply; and a plurality of light source sockets, each of said sockets having spring biased engaging means for removably engaging, electrically and mechanically said first and said second rigid conductive members such that said light source sockets may be positioned selectively along said elongated conductive members and electrical power can be supplied through said conductive members to said light source sockets.

* * * * *

UNITED STATES PATENT AND TRADEMARK OFFICE

CERTIFICATE OF CORRECTION

PATENT NO. : 4,748,545

DATED : May 31, 1988

INVENTOR(S) : Lawrence O. Schmitt

It is certified that error appears in the above-identified patent and that said Letters Patent is hereby corrected as shown below:

Column 1, line 45:

After the words "comparable to", --fluorescent fixtures-- should be inserted.

Column 8, line 48:

The word "proYided" should be --provided--.

Signed and Sealed this

Fifteenth Day of November, 1988

*Attest:*

DONALD J. QUIGG

*Attesting Officer*

*Commissioner of Patents and Trademarks*